US005528108A

United States Patent [19]

Cisneros

[11] Patent Number: 5,528,108

[45] Date of Patent: Jun. 18, 1996

[54] FIELD EMISSION DEVICE ARC-SUPPRESSOR

[75] Inventor: Ralph Cisneros, Tempe, Ariz.

[73] Assignee: Motorola, Schaumburg, Ill.

[21] Appl. No.: 321,181

[22] Filed: Sep. 22, 1994

[51] Int. Cl.[6] ..... G09G 3/10

[52] U.S. Cl. ..... 315/169.3; 315/169.4; 315/169.1; 315/356; 315/283

[58] Field of Search ..... 315/169.3, 169.4, 315/169.1, 356, 283

[56] References Cited

U.S. PATENT DOCUMENTS 5,142,184 8/1992 Kane .

5,283,501 2/1994 Zhu et al. ..... 315/169.3

*Primary Examiner*—Frank Gonzalez
*Assistant Examiner*—Reginald A. Ratliff
*Attorney, Agent, or Firm*—Robert F. Hightower; Eugene A. Parsons

[57] ABSTRACT

A field emission device (10) has an anode (18) that is used to attract electrons emitter by an emitter (13). An inductor (19) is coupled in series between the anode (18) and a voltage source (21) in order to prevent arcing between the anode (18) and the emitter (13) of the field emission device (10).

4 Claims, 1 Drawing Sheet

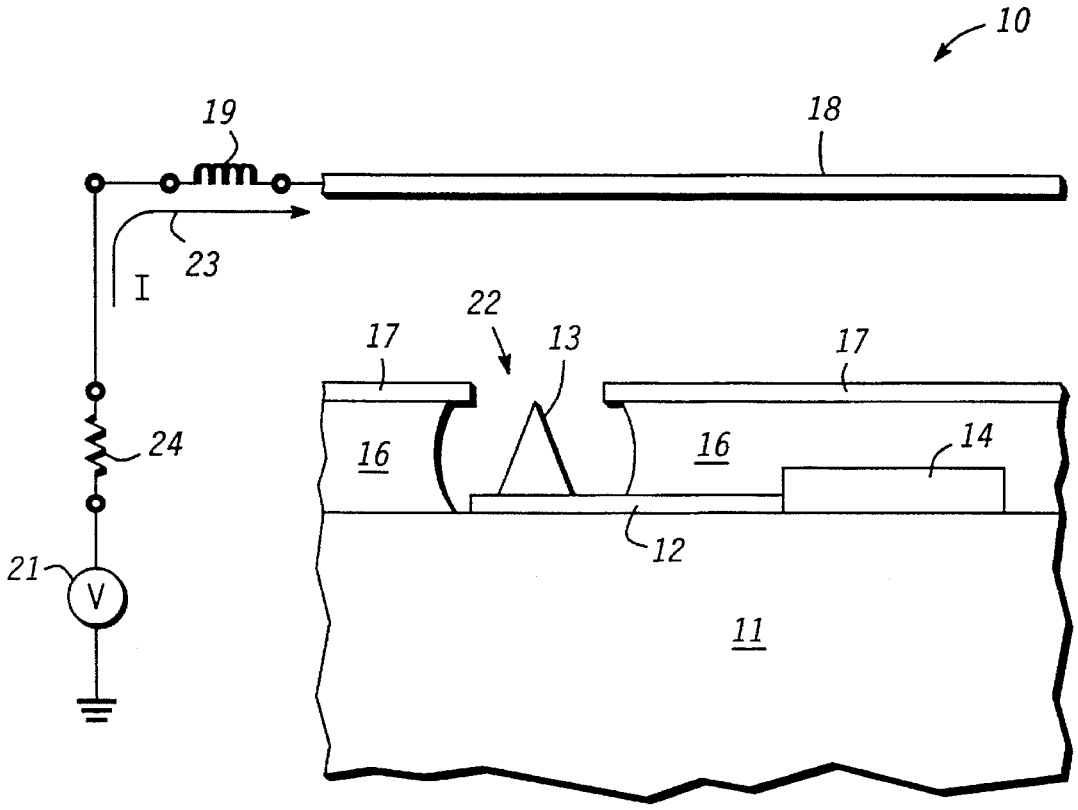
10
19
18
23
I
22
17
13
17
24
16
16
14
12
21
V
11

FIELD EMISSION DEVICE ARC-SUPPRESSOR

BACKGROUND OF THE INVENTION

The present invention relates, in general, to electron emission devices, and more particularly, to a novel arc-suppressor for field emission devices.

Field emission devices (FEDs) are well known in the art and are commonly employed for a broad range of applications including image display devices. An example of a FED is described in U.S. Pat. No. 5,142,184 issued to Robert C. Kane on Aug. 25, 1992. Prior FEDs typically have a cathode or emitter that is utilized to emit electrons that are attracted to a distally disposed anode. A large positive potential typically is applied to the anode in order to attract the electrons. Often, arcing or breakdown occurs between the anode and the emitter. The arcing or breakdown usually results from an inefficient vacuum in the space between the anode and the emitter or from particles in the space. During the arcing, a large current typically flows from an external voltage source through the anode, and then flows through the ionized vacuum to the emitter as an electrical arc. The arc generally damages or destroys the emitter. Often the emitter erupts causing emitter particles to be dispersed into the vacuum thereby causing other shorts and damaging other emitters.

Accordingly, it is desirable to have a field emission device that prevents damaging the emitter during breakdown or arcing between the anode and the emitter, and that substantially limits arcing between the anode and the emitter.

BRIEF DESCRIPTION OF THE DRAWINGS

The sole FIGURE schematically illustrates an enlarged cross-sectional portion of a field emission device in accordance with the present invention.

DETAILED DESCRIPTION OF THE DRAWINGS

The sole FIGURE schematically illustrates an enlarged cross-sectional portion of a field emission device (FED) 10 that has a novel anode to emitter arc suppression scheme. Device 10 includes a substrate 11 on which other portions of device 10 are formed. Substrate 11 typically is an insulating or semi-insulating material, for example, glass or silicon having a dielectric layer thereon. A row conductor or cathode conductor 14 generally is on substrate 11 and is utilized to make electrical contact to a cathode or emitter 13 through a cathode electrode 12. Electrode 12 can be a conductor or a resistive layer that controls current flow between emitter 13 and an extraction grid or gate 17. Conductor 14 typically is used to interconnect a plurality of emitters in a column configuration. Such column configurations are well known to those skilled in the art. A first dielectric or insulator 16 is formed on substrate 11, on conductor 14, and on a portion of electrode 12 in order to electrically isolate emitter 13 and conductor 14 from gate 17 that is formed on insulator 16. Gate 17 typically is a conductive material having an emission opening 22 that is substantially centered to emitter 13 so that electrons may pass through gate 17. Emitter 13 emits electrons that are attracted to an anode 18 distally disposed from emitter 13. A voltage source 21 is utilized to apply a positive potential to anode 18 to facilitate the attraction. The space between emitter 13 and anode 18 generally is evacuated to form a vacuum in order to minimize arcing between emitter 13 and anode 18.

In prior art FEDs, electrons emitted from the emitter are attracted to the anode by applying a large positive voltage, typically about ten thousand volts, to the anode. Because of the large potential difference between the anode and the emitter, breakdown and arcing can occur between the emitter and the anode if the space between the emitter and the anode does not have a sufficient vacuum or if the anode is too close to the emitter.

Electrical arcing from the anode to the emitter is accompanied by a large current surge from the voltage source through the anode. It has been found that limiting the rate of change of an anode current 23, illustrated by an arrow, flowing to anode 18 can prevent arcing from damaging emitter 13, and also can limit the occurrence of arcing. It has also been found that limiting the rate of change of current 23 is facilitated by coupling an inductor 19 in series between anode 18 and source 21. When the voltage on anode 18 is sufficient to cause arcing between anode 18 and emitter 13, inductor 19 limits the rate of change of current flow to or through anode 18 thereby limiting the rate of change of current that may flow to emitter 13. Limiting the rate of change of current 23 limits the amount of electrical energy discharged to emitter 13 thereby preventing damage to emitter 13. If the rate of change of current 23 is small enough, arcing may be substantially prevented. Consequently, inductor 19 functions as an arc-suppressor for device 10.

In the preferred embodiment, inductor 19 has a value of at least approximately thirty milli-henries, and source 21 has a value of at least approximately ten thousand volts which limits the rate of change of current 23 during arcing to less than approximately one milli-amp per nanosecond. Also a one hundred milli-henry inductor limits the rate of change of current 23 during arcing to less than approximately 0.3 milli-amps per nanosecond for the same value of source 21.

The closer inductor 19 is to the electrical input terminal of anode 18, the more effectively inductor 19 can limit the rate of change of current flowing to or through anode 18. In the preferred embodiment, inductor 19 is mounted directly to anode 18, and has a first terminal connected to a voltage input terminal of anode 18 and a second terminal connected to a positive output terminal of source 21. Source 21 also has a negative output terminal that typically is connected to ground. Furthermore, a resistor 24 can be connected in series with inductor 19 in order to limit current flow if a continuous short develops between anode 18 and other elements of device 10. The value of resistor 24 generally is at least approximately 1 meg-ohm.

By now it should be appreciated that there has been provided a field emission device with a novel arc-suppressor or breakdown suppression scheme. By connecting an inductor in series with the anode, the rate of change of anode current is limited. Consequently, the emitter is protected because the inductor limits the energy in an arc to a value that does not damage the emitter.

I claim:

1. A method of protecting a field emission device comprising:

coupling an inductor in series between an anode of the field emission device and a voltage source for limiting a rate of change of current flowing to the anode.

2. The method of claim 1 wherein limiting the rate of change of current flowing to the anode includes limiting the rate of change of current to a value of less than approximately 1 milli-amp per nanosecond.

3. The method of claim 1 further including coupling a resistor in series with the inductor.

4. The method of claim 1 wherein coupling the inductor includes coupling the inductor having a value of at least approximately 30 milli-henries.

* * * * *